United States Patent [19]

Jones

[11] 3,951,774

[45] Apr. 20, 1976

[54] ELECTROLYTIC CELL CONSTRUCTION

[75] Inventor: Glenn C. Jones, Kingsport, Tenn.

[73] Assignee: Eastman Kodak Company, Rochester, N.Y.

[22] Filed: Dec. 23, 1974

[21] Appl. No.: 536,044

[52] U.S. Cl. ..... 204/272; 204/78; 204/275

[51] Int. Cl.[2] ..... C25C 7/00; C25C 7/02

[58] Field of Search ..... 204/78, 260, 272, 275, 204/DIG. 7

[56] References Cited

UNITED STATES PATENTS 3,509,031 4/1970 Covitz ..... 204/78

FOREIGN PATENTS OR APPLICATIONS 1,104,078 2/1968 United Kingdom ..... 204/272

*Primary Examiner*—John H. Mack
*Assistant Examiner*—A. C. Prescott
*Attorney, Agent, or Firm*—J. Frederick Thomsen; Daniel B. Reece, III

[57] ABSTRACT

An electrolytic cell useful in the oxidation of organic compounds is disclosed. The cell provides a more uniform current density by shielding areas of non-uniform electrode spacing, thereby minimizing tar formation, power losses and undesirable reactions of oxidized products.

4 Claims, 1 Drawing Figure

ELECTROLYTIC CELL CONSTRUCTION

Figure 1:
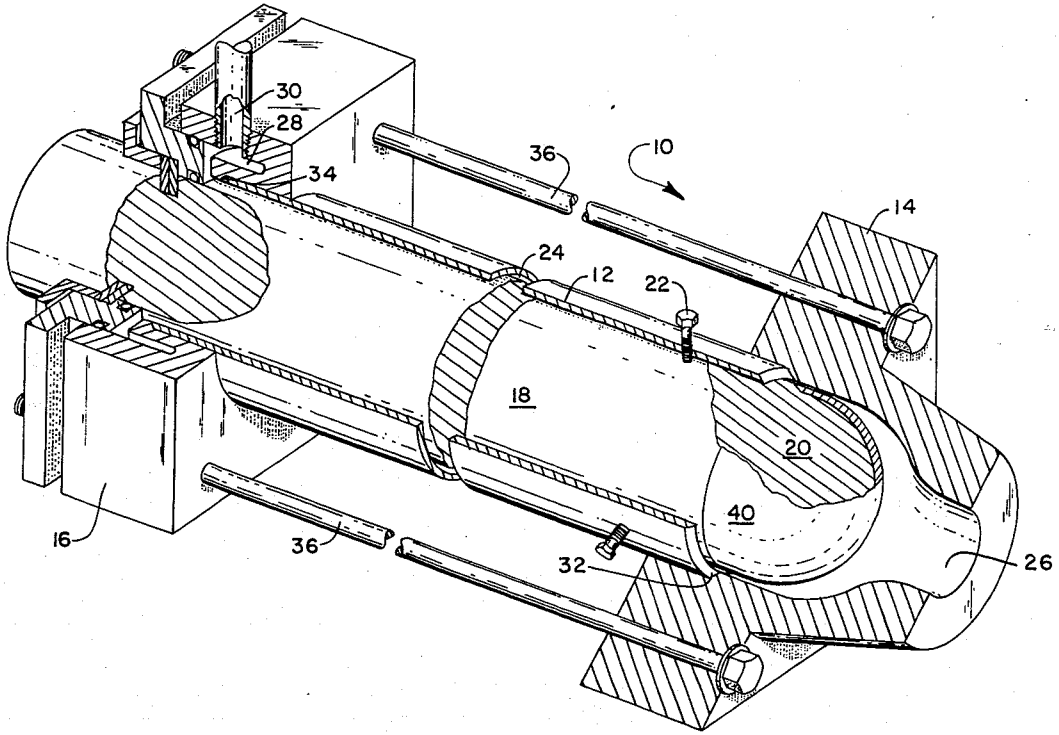

This invention relates generally to electrochemical oxidation processes and more specifically this invention relates to improved electrolytic cell construction for the oxidation of organic compounds.

The electrolytic oxidation of organic compounds is well known in the art. For example, U.S. Pat. No. 3,509,031 teaches the preparation of hydroquinone by electrolyzing an aqueous solution of phenol. Other well-known electrolytic oxidation processes include oxidation of benzene to p-benzoquinone, such as disclosed in Belgium Patent No. 777,905. Numerous other electrolytic oxidation processes are known in the art.

The electrolytic cell constructed in accordance with this invention is useful in electrolytic processes where undesirable tar formation and accumulation on the electrode is caused by low current density areas. Such abnormal tar formation and accumulation may occur in organic reactions where the space between electrodes is relatively large. For example, it is often desirable from a manufacturing standpoint to construct the electrolytic cell in a manner such that the corresponding ends of the anode and cathode do not conform in shape. The end of the cell may most desirably be of a non-conductive material so as not to be a part of the electrode at all, in which case the cathode is of a hollow cylindrical shape. The anode may conveniently be cylindrical with a rounded or dome-shaped end, in which case there would be a relatively large distance from points on the rounded end to the nearest part of the cathode. Operation of the cell causes low current density at the rounded or dome-shaped end of the anode, resulting in decreased electrical efficiency in some processes. Consequently, there may be power losses, excessive heating, formation of oxygen or hydrogen, or the products themselves may be further reacted to lower chemical yields. The higher electrical efficiency realized using this process results in a lower cost per pound of product produced in the process, thereby allowing one to economically achieve higher concentrations of oxidized compound in the product stream, thus reducing the capital requirements for a plant. Formation of tars on the end of the anode eventually results in tar coating of the electrodes generally. This has a number of adverse effects on the process, causing interruption of the operation for cleaning the equipment.

This invention is especially important with respect to the electrochemical oxidation of phenol to hydroquinone, including the electrochemical oxidation of substituted phenols such as o-cresol to corresponding substituted hydroquinone.

The term "phenol", as used herein, is intended to include alkyl-substituted phenols wherein the alkyl groups have a carbon content of 1 to 4 carbon atoms and are positioned ortho or meta to the hydroxyl group, and the term "hydroquinone", as used herein, is intended to include alkyl-substituted hydroquinones wherein the alkyl group has a carbon content of 1 to 4 carbon atoms.

It is therefore an object of this invention to provide an improved electrolytic cell construction.

It is another object of this invention to provide an improved electrolytic cell for the electrolytic oxidation of organic compounds wherein electrical current efficiency is substantially improved.

It is a further object of this invention to provide an improved electrolytic cell for the electrochemical oxidation of phenol to hydroquinone wherein good yields of hydroquinone are obtained.

It is still another object of this invention to provide an electrolytic cell in which the oxidation of phenol can be carried out for extended periods without cleaning.

According to the present invention, an electrolytic cell is provided which is especially suitable for the oxidation of aromatic compounds, particularly oxdiation of phenol to hydroquinone. For example, U.S. Pat. No. 3,509,031 discloses a process for oxidizing phenol to hydroquinone or benzoquinone at high chemical and electrical efficiencies by electrolyzing aqueous solutions of phenol at temperatures of 25° to about 100°C., a pH of less than about 4 at a current density of 4 to about 100 amperes/dm$^2$ until up to about 80% by weight of the phenol has been electrolyzed. This patent points out that an undivided cell provides hydroquinone as the main product of the electrolysis of phenol.

The present invention provides an electrolytic cell which is especially useful in producing hydroquinone in accordance with the process described in this patent, i.e., in an undivided cell.

In the drawing:

FIG. 1 is a perspective view, partially in section, of the electrolytic cell constructed in accordance with this invention.

Referring now to the drawing, electrolytic cell 10 includes a hollow, cylindrical cathode 12 having insulating end members 14 and 16. A cylindrical anode 18 is positioned within the cathode 12 and extends for substantially the full length thereof. The end 20 of anode 18 extends beyond the end of the cathode 12 and is supported at this end by several centering screws 22 angularly spaced around the periphery of the cathode. The cathode 12 and anode 18 define an annular passage 24 for flow of the compound to be oxidized. The annular passage 24 is generally between about 2 mm. and 15 mm. in width. The centering screws 22 are fabricated from insulating material.

End member 14 is provided with an inlet opening 26 which may be suitably connected to a pipe (not shown) from the supply of compound to be oxidized. End member 16 is provided with a circular manifold 28 which receives compound from the annular passage 24. The circular manifold 28 opens to a discharge outlet 30 fixed thereto, which is suitably connected to a pipe (not shown) through which the oxidized compound flows.

The end members 14 and 16 are suitably fixed to the ends of the cathode in liquid tight relationship. Pressure is exerted at sealing points 32 and 34 by means of a plurality of tie rods 36 which may be tightened to the extent necessary to maintan the end members in position for sealing purposes. The cathode 12 and anode 18 are connected to a source of D.C. electricity by suitable connectors (not shown).

The cathode 12 and anode 18 may be fabricated from conventional materials known to those skilled in the art. As to the choice of anode materials, any metal which is stable in the electrolyte or which passivates under the electrolysis conditions may be used, such as, for example, platinum, gold, graphite, manganese, chromium, iron, nickel, lead and alloys thereof and the like. Lead dioxide is preferred as the anode material for oxidation of phenol to p-benzoquinone. As the cathode material, any metal which is stable to the electrolysis conditions may be used. Suitable cathode materials include such metals as lead, tin, cadmium, copper, nickel, and the like. Of course, it is to be understood that the list of these materials mentioned as being useful as anodes and cathodes is not exclusive, and any of the metals which meet the above qualifications may be used if desired.

The insulating end members 14 and 16 may be fabricated from suitable materials such as, for example, plastic. Polypropylene is found to be suitable for this purpose.

It is recognized in the art, for example in U.S. Pat. No. 3,509,031, that high current densities are desirable from several standpoints, including lessening tar formation on the anode. Tar tends to form and build up on lead dioxide anodes in areas of low current density. It is also recognized in the art that tar formation on the anode is responsible for reducing electrical efficiency as the electrolysis proceeds. In a cell having non-uniform spacing of electrodes, the current density will be inversely proportional to the distance between the anode and cathode. In the preferred type of anode having a rounded end and no corresponding cathode area close by, the current density will be much less than over the outer cylindrical surface which is closely positioned to the inner cylindrical surface of the cathode, or, in other words, the "straightaway" position. Thus, undesirable tar formation and build up has been found to occur in operation of such cells at the terminal rounded end of the anode.

According to the present invention, a shield of cap 40 of insulating material is fixed to the end of the anode which has no matching or conforming cathode surface such as the cylindrical sides of the anode. For example, the cathode is normally a cylindrical structure, with at least a portion of its end removed to allow entrance of the organic liquid compound to be oxidized. In the preferred type of cell illustrated in the drawings, the cathode is a hollow, cylindrical member with no ends. Insulating end members are adjacent the rounded end of the anode. The distance between the end of the anode and the nearest point of the cathode thus increases to the tip of the anode. Thus, with cap 40 provided on the anode, forming an insulative barrier between the cavity through which the organic compound passes and the end of the anode, the organic compound is not subjected to the influence of the anode's electrical potential and consequently, no abnormal tar formation.

Cap or shield 40 may conveniently be fabricated from an insulating material such as, for example, plastic. Polypropylene is found to be very suitable. Cap 40 may be secured to the anode 18 by means of adhesive. One suitable way of securing cap 40 to anode 18 is by forming one or more holes in the end of anode 18 and forming corresponding or matching prongs on the cap, and subsequently fitting them together with adhesive.

Operation of the electrolytic cell will now be described with reference to the oxidation of phenol to hydroquinone.

The electrolytic cell constructed in accordance with this invention is used according to conventional techniques. For example, one suitable process is disclosed in the aforementoned U.S. Pat. No. 3,509,031.

The concentration of phenol in aqueous solution being electrolyzed is limited to an upper limit of about 4 percent by weight, and a lower practical limit of about 0.5 percent by weight. Although the concentration of phenol in the aqueous solution can be as high as about 4 percent by weight, about 3 percent is preferred. Above 4 percent phenol concentration, conversion efficiency drops, the remainder appearing as tars or low molecular weight condensation products which adhere to the electrode surface. Conventional cosolvents may be used. Tar formation, as mentioned before, is responsible to some extent in reducing electrical efficiency as the electrolysis proceeds.

When this invention is practiced in the preferred continuous process, temperature of about 25° to 100°C. can be used. It is preferred to operate continuously in the range of about 30° to 80°C., with the range of about 40°–75°C. being more preferred.

The concentration of electrolyte is not narrowly critical, but it is preferred to operate in the range of about 1 to 5 percent by weight when the electrolyte is an inorganic acid. This range is preferred because of the relatively minor variations in electrical efficiency over this range as well as having sufficient conductivity to allow high current densities without excessive heating from power dissiptation. When the electrolyte consists of a mixture of an inorganic acid and an ionizable salt, the salt concentration can range from about 1 to 10 percent by weight, or 1 to 20 percent by weight and even as high as about 30 percent by weight.

Suitable electrolytes comprise any materials which ionize readily in water at a pH of 4 or less and preferably 2 or less and do not interfere with the phenol electrolysis. Specific examples include inorganic acids, such as sulfuric acid, phosphoric acid and the like; inorganic salts such as sodium sulfate, sodium bisulfate, potassium sulfate, potassium bisulfate, lithium sulfate, lithium bisulfate, sodium phosphate and the like, in conjunction with sufficient inorganic acid to maintain a pH of 4 or less; and organic salts such as sodium acetate, potassium acetate, lithium acetate, and the like, in a solution acidified to a pH of 4 or less.

In order to maintain optimum anode efficiency, one may clean the electrodes by immersion in a hydrocarbon tar solvent, as for example, ketones such as acetone, alcohols such as ethanol, or aromatic hydrocarbons such as benzene, toluene, and the like. This can be done by a rinsing operation in which the electrodes are left intact mounted in the electrolytic cell. In the most preferred ranges of current density, later defined, this cleaning operation is not required.

An important variable of the present process is the anode potential. This value has a minimum below which oxidation of phenol by electrolysis will not occur. This value is approximately +0.9 volt with respect to a saturated calomel electrode as measured by standard voltammetric techniques. It is preferred to employ an anode potential of about +0.9 to +3.5 volts with a range of +1.8 to +3.0 volts being more preferred. The cathode potential should be less than about +0.4 volt.

For the same considerations, the current density is also important since, for a given system, the electrode potential is usually a single-valued function of the current density. The electrode potential may therefore be controlled by adjusting the current density Also, since the conversion rate per unit area of electrode surface is determined as much by the current density as by the electrical efficiency, it is desirable to operate at high current densities. The preferred range of current densities for the oxidation of phenol by electrolysis is about 4 to 100 amperes/dm.$^2$ with about 20 to about 60 being especially preferred. It is not practical to operate below 4 amperes/dm.$^2$ because of tar formation on the anode which lowers the efficiency of the phenol electrolysis to a point where the oxidative process is no longer commercially feasible. The use of high current densities in the practice of this process carries with it the added economic advantage of reducing the number of cells required for the electrolytic oxidation of phenol.

Pressure is not critical and, while it is preferred to use atmospheric pressure for convenience, superatmospheric as well as subatmospheric pressures may be employed if desired.

The degree of conversion to which the phenol substrate is subjected is important. For example, after about 50 percent conversion of phenol to hydroquinone by electrolysis, the overall electrical efficiency begins to drop. Approximately 80 percent is the upper practical limit of conversion of phenol. The formation of side products becomes more appreciable above the 80 percent phenol conversion level and aside from the depreciation in yield, conversion beyond this point is undesirable because of tar sticking to the electrode surface which results in reduction in the rate of diffusion of phenol to the anode.

The product stream can be continuously extracted with a low boiling, water-immiscible solvent, such as diethyl ether, in which the organic materials are soluble. The ether stream can be then fed into a vessel containing a higher boiling solvent in which both phenol and p-benzoquinone are soluble but in which hydroquinone is quite insoluble, such as carbon tetrachloride. The ether is recycled and the hydroquinone filtered from the carbon tetrachloride solution and subsequently recrystallized in conventional apparatus. The carbon tetrachloride filtrate which contains traces of p-benzoquinone, as well as unreacted phenol, can be re-extracted with the aqueous phase from the first extraction and reused. The aqueous phase can then be returned to the electrolysis cell after appropriate replenishment with phenol.

It is known in the art that current density in an electrolytic cell between the anode and cathode is inversely proportional to the spacing between them at any given point. It is also known that tar forms at areas of low current densities. By use of an electrolytic cell constructed in accordance with the foregoing specification, tar formation in organic oxidation processes at areas of low current densities is minimized.

Where the term "insulating" is used herein, it is intended to mean electrically insulating.

Although the invention has been described in considerable detail with particular reference to certain preferred embodiments thereof, variations and modifications can be effected within the spirit and scope of the invention.

I claim:

1. In an electrolytic cell wherein an aromatic compound is oxidized as it is caused to flow through the cell, said cell having a hollow, cylindrical cathode and a smaller cylindrical anode positioned inside of and substantially coaxial with said cathode defining an annular passage for flow of said aromatic compound between the electrodes, and a pair of openings in said cathode for feed and discharge of said aromatic compound, said anode having a domeshaped end exposed inside the cell whereby the distance from points on the dome-shaped end to the nearest part of the cathode is relatively large, the improvement which comprises an insulating shield attached to and substantially covering the dome-shaped end of said anode.

2. In an electrolytic cell according to claim 1, the improvement wherein said shield is fabricated from a plastic material.

3. In an electrolytic cell according to claim 1, the improvement wherein said shield is fabricated from polypropylene.

4. In an electrolytic cell according to claim 1, the improvement wherein shield is adhesively connected to said anode.

* * * * *